US007673672B2

(12) United States Patent
Velzy et al.

(10) Patent No.: US 7,673,672 B2
(45) Date of Patent: Mar. 9, 2010

(54) NON-BRAZED INSERT FOR HEAT EXCHANGER

(75) Inventors: Jodie Velzy, Fenton, MI (US); Jacob Wright, Royal Oak, MI (US); Yoshikazu Miyano, West Bloomfield, MI (US)

(73) Assignee: Denso International America, Inc., Southfield, MI (US)

( * ) Notice: Subject to any disclaimer, the term of this patent is extended or adjusted under 35 U.S.C. 154(b) by 112 days.

(21) Appl. No.: 11/639,957

(22) Filed: Dec. 15, 2006

(65) Prior Publication Data

US 2008/0142200 A1 Jun. 19, 2008

(51) Int. Cl.
*F28D 1/053* (2006.01)

(52) U.S. Cl. ..... 165/149; 165/175

(58) Field of Classification Search ..... 165/149, 165/152, 153, 173, 175
See application file for complete search history.

(56) References Cited

U.S. PATENT DOCUMENTS

| | | | | |
|---|---|---|---|---|
| 3,310,869 | A * | 3/1967 | La Porte et al. | 29/890.03 |
| 5,662,162 | A * | 9/1997 | Fukuoka et al. | 165/149 |
| 5,678,628 | A * | 10/1997 | Aki et al. | 165/173 |
| 5,894,885 | A * | 4/1999 | Paquet | 165/149 |
| 6,318,454 | B1 * | 11/2001 | Schule et al. | 165/140 |
| 2005/0133208 | A1 * | 6/2005 | Powers et al. | 165/149 |

* cited by examiner

*Primary Examiner*—Teresa J Walberg
(74) *Attorney, Agent, or Firm*—Harness, Dickey & Pierce, PLC

(57) ABSTRACT

A heat exchanger has a plurality of tubes and a plurality of fins alternatively arranged to define a core portion of the heat exchanger. A side plate is arranged at opposite sides of the core portion. Each end of the tubes and side plates extend through a core plate. Each core plate mates with a respective tank to define a sealed chamber. The ends of the tubes are disposed within the sealed chamber. The ends of the side plates and disposed outside the sealed chamber. This allows for a non-brazed connection between the core plates and the side plates.

20 Claims, 3 Drawing Sheets

NON-BRAZED INSERT FOR HEAT EXCHANGER

FIELD

The present disclosure relates to heat exchangers. More particularly, the present invention relates to a heat exchanger which includes a side insert or side plate which is secured to the core plate mechanically without the use of brazing.

BACKGROUND

The statements in this section merely provide background information related to the present disclosure and may not constitute prior art.

Heat exchangers are used to exchange heat between two fluids. In the automotive industry, a heat exchanger in the form of a radiator is used to exchange heat between an engine cooling fluid and air. In addition, a heat exchanger is used to exchange heat between the engine coolant fluid and air to be blown into the passenger compartment to heat the air. Also, a heat exchanger in the form of a condenser is used to exchange heat between a refrigerant and air. Finally, a heat exchanger in the form of an evaporator is used to exchange heat between a refrigerant and air that is to be blown into the passenger compartment to cool the air.

Each of these heat exchangers includes a plurality of tubes through which a fluid flows, a plurality of fins arranged between adjacent tubes to be bonded to the tubes, a core plate connected to each longitudinal end of the plurality of tubes, a tank member disposed at each end of the plurality of tubes and an insert or side plate located at opposite sides of the plurality of tubes and fins. The inserts or side plates provide stability to the assembled heat exchanger.

Typically, the plurality of tubes and the inserts or side plates extend through apertures formed in each core plate and this assembly is brazed to maintain its integrity as well as to seal the interface between the tubes and the core plates and interface between the inserts or side plates and the core plates.

When both the insert or side plates and the plurality of tubes are brazed to the core plate, problems can occur due to thermal stress. In cold ambient temperatures and hot coolant conditions, the tubes want to expand due to their increased temperature due to the hot coolant. The inserts or side plates want to contract due to the cold ambient temperature. This creates relatively high stresses at the interfaces between the tubes and core plates and the interfaces between the inserts or side plates and the core plates. This high stress creates the potential for cracking and cooling leaks.

SUMMARY

The present disclosure describes a heat exchanger where the tubes and core plates are brazed together. The inserts or side plates are mechanically connected to the core plates rather than being brazed or in the alternative the inserts or side plates can be lightly brazed to the core plates. The interface region between the inserts or side plates and core plate is located outside of the sealed area of the radiator tank. This structure allows the tubes to expand when necessary without being constrained by the insert or side plate.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
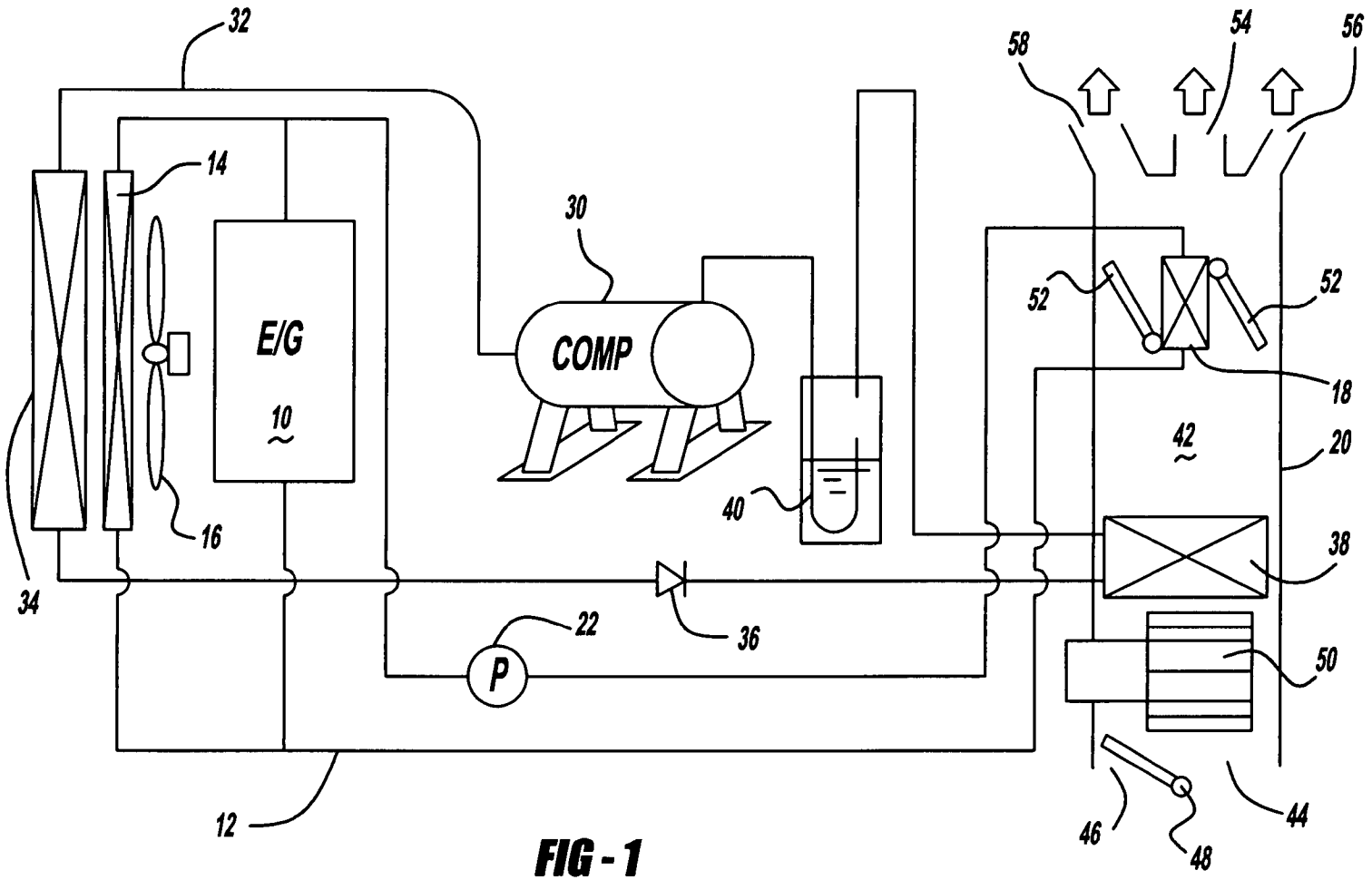
FIG. 1 is a schematic view of a vehicle cooling system and a vehicle air conditioning system.
Figure 2:
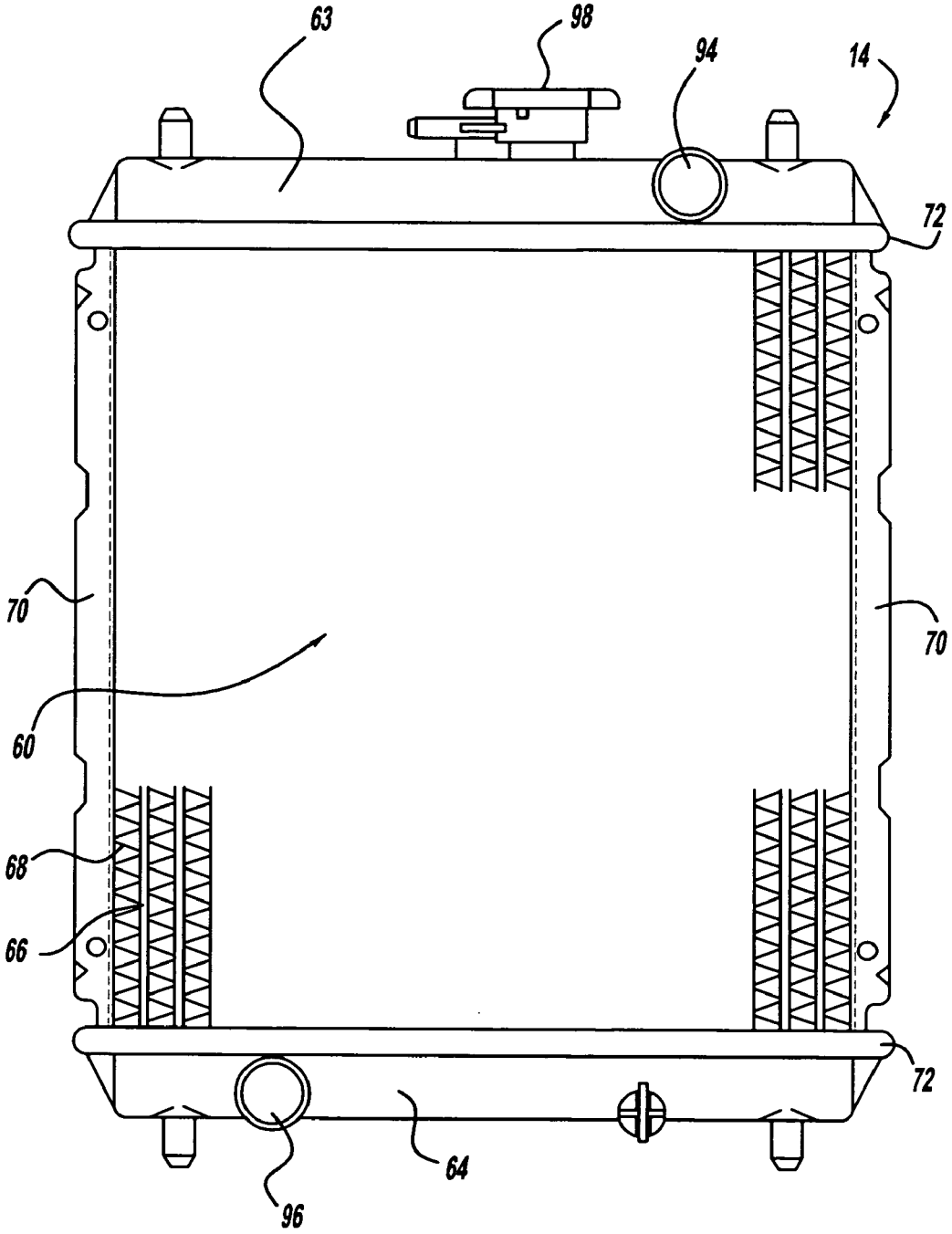
FIG. 2 is a front view of the heat exchanger illustrated in the vehicle cooling system of FIG. 1.

The following description is merely exemplary in nature and is not intended to limit the present disclosure, application, or uses. There is illustrated in FIG. 1, a typical cooling and heating system for an automobile. A water cooled engine 10 is cooled by water flowing through a water circuit 12. Hot water from engine 10 is sent to a radiator or heat exchanger 14. A fan 16 draws air through radiator or heat exchanger 14 for cooling purposes. The water leaving heat exchanger or radiator 14 is routed back to engine 10 by water circuit 12. Hot water from engine 10 is also sent to a heat exchanger 18 which is located within an air conditioning case 20 for heating a passenger compartment of the vehicle. The water returned from heat exchanger 18 is routed back to engine 10 by water circuit 12. A pump 22 controls the flow of water within water circuit 12.

An air conditioning system includes a compressor 30 which compresses refrigerant flowing through a refrigerant circuit 32. Compressed refrigerant from compressor 30 is sent to a condenser or heat exchanger 34 which also receives air drawn by fan 16. Refrigerant from condenser or heat exchanger 34 passes through an expansion valve 36 and then to an evaporator or heat exchanger 38 through refrigerant circuit 32. Evaporator or heat exchanger 38 is also disposed within casing 20 and it is used to cool the passenger compartment of the vehicle. The refrigerant leaving evaporator or heat exchanger 38 flows through refrigerant circuit 32 and is sent to a gas/liquid separator 40 and from gas/liquid separator 40, the refrigerant in gas form is drawn into compressor 30.

Air-conditioning case 20 defines an air passage 42 through which air flows into the passenger compartment. An inside air inlet 44 for introducing air from inside the passenger compartment and an outside air inlet 46 for introducing air from outside the passenger compartment are provided at an upstream end of case 20. An inside/outside air switching door 48 is located to open and close inlets 44 and 46. A centrifugal blower 50 draws air in through inlets 44 and 46 and blows this air through evaporator 38, and heat exchanger 18 located within air passage 42 and then into the passenger compartment. An air mixing door 52 adjusts the temperature of the air to be blown into the passenger compartment.

A face opening 54 blows air toward the upper portion of a passenger. A foot opening 56 blows air toward a lower portion of a passenger. A defroster opening 58 blows air toward a windshield of the vehicle for defrosting and defogging of the windshield.

Referring now to FIGS. 2-5, heat exchanger or radiator 14 is illustrated in greater detail. While the present disclosure is being described using heat exchanger or radiator 14, it is within the scope of the present invention to have heat exchanger 18, condenser or heat exchanger 34 and evaporator or heat exchanger 38 incorporate the features of the present disclosure.

Heat exchanger or radiator 14 comprises a core portion 60, a first tank member 62 and a second tank member 64. Core portion 60 comprises a plurality of tubes 66, a plurality of fins 68, a pair of inserts or side plates 70 and a pair of core plates 72.

Each of the plurality of fins 68 is a corrugated fin formed into a wave shape by bending a thin plate. The plurality of tubes 66 and the plurality of fins 68 are alternately stacked with each other. Inserts or side plates 70 are attached to the outermost fin on each side of core portion 60 to reinforce core portion 60. Inserts or side plates 70 extend in the same longitudinal direction as the plurality of tubes 66.

Each core plate 72 is provided with a plurality of tube holes 74 within which an end portion of the plurality of tubes are inserted. Each core plate 72 also includes a pair of insert or side plate holes 76 within which a respective insert or side plate 70 is inserted. Each core plate 72 also defines a generally rectangular sealing surface 80 which extend along the two longitudinal edges of core plate 72 and extends between the outermost tube holes 74 and the insert or side plate holes 76. In addition, each core plate 72 has a tank insertion portion 82 at its outer peripheral portion within which an outer peripheral portion 84 of first and second tank members 62 and 64 are inserted so that a tank space 86 communicating with the plurality of tubes 66 is formed. A seal 88 interfaces between sealing surface 80 of core plate 72 and outer peripheral portions 84 of tank members 62 and 64 to seal tank space 86 from the outside environment. Furthermore, a plurality of claw portions 90 are located along the outer periphery of each core plate 72. Claw portions 90 are crimped over to maintain the attachment of tank members 62 and 64 to their respective core plate 72.

First and second tank member 62 and 64 are preferably made of a resin material such as a nylon material including glass fiber to have heat resistance and strength sufficient for the application. While tank members 62 and 64 are described as being made of a resin, other materials for tank members 62 and 64 can be utilized. Each tank member 62 and 64 is formed into an approximate U-shape in cross section. The open end of the U-shape faces its respective core plate 72. A plurality of ribs 92 are spaced along the smaller end wall of each tank member 62 and 64 to provide additional stiffness to tank members 62 and 64 and thus preventing any warping.

An inlet pipe 94 and an outlet pipe 96 are provided in tank members 62 and 64 to allow for the inflow and outflow of coolant. Additionally, a cooling filling port 98 is provided in tank member 62 for maintaining the supply of coolant in the system.

Figure 3:
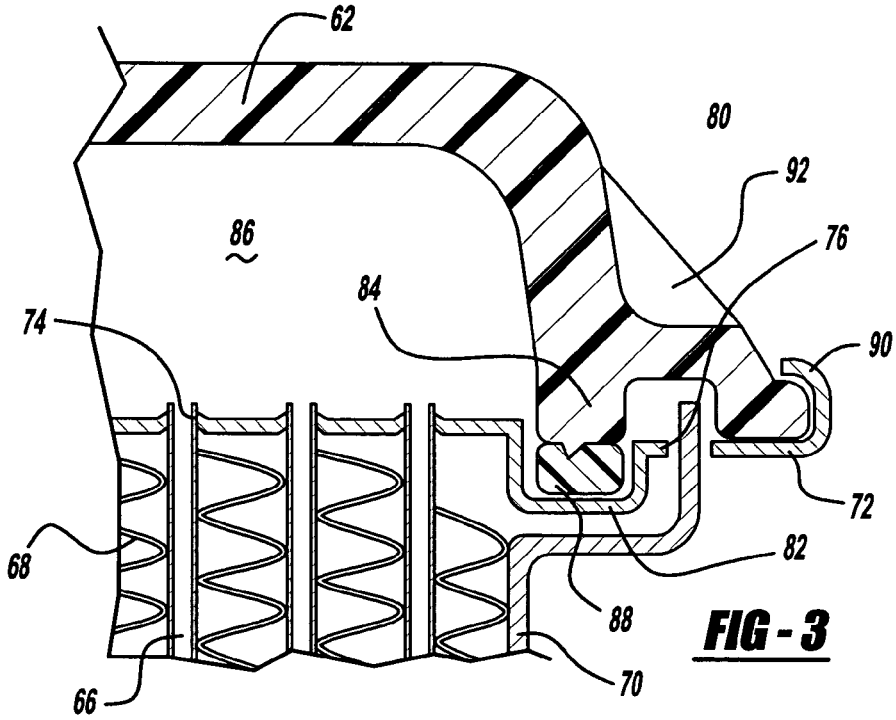
FIG. 3 is an enlarged cross-sectional view of the upper portion of the heat exchanger illustrated in FIG. 2.
Figure 4:
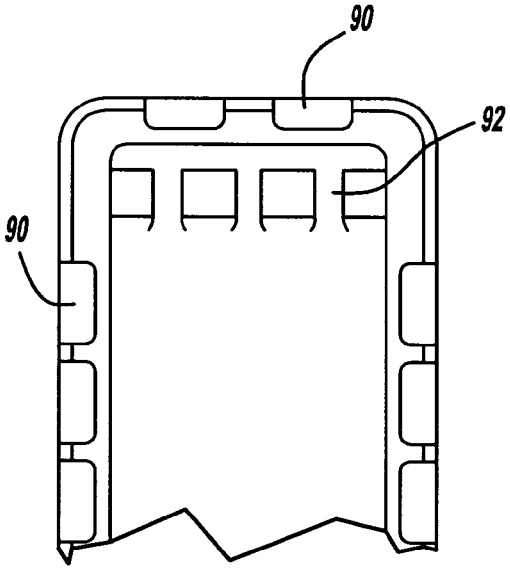
FIG. 4 is a top view of one end of the heat exchanger illustrated in FIG. 2.
Figure 5:
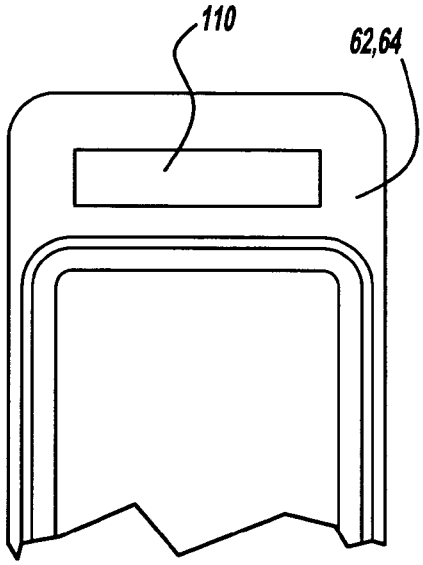
FIG. 5 is a partial bottom view of the header tank illustrated in FIG. 2.

Referring to FIG. 3, the insert or side plate holes 76 are located at a position outside of the tank space 86. An insert or side plate pocket 110 is defined by each side of each header tank 62 and 64. Each end of each insert or side plate 70 extend through a respective insert or side plate hole 76. The end of insert or side plate 70 can be inserted through the respective insert or side plate hole 76 without any retention device, or a retention device such as a light brazing can be utilized to secure the connection. Each insert of side plate 70 is brazed to the adjacent fin 68 so movement of insert or side plate 70 with respect to the remainder of core portion 60 is prohibited.

The separation of the connection of each insert or side plate 70 and the connection of each tube 66 with core plates 72 eliminates the thermal stress and the associated problems in cold ambient temperatures with hot fluid running through tubes 66.

What is claimed is:

1. A heat exchanger comprising:

a plurality of tubes;

a plurality of fins, each of said fins being disposed adjacent at least one of said plurality of tubes;

a pair of side plates, each of said side plates being disposed adjacent an outermost fin;

a pair of core plates, each of said core plates being disposed at a longitudinal end of said tubes and said side plates, each of said core plates defining a plurality of tube holes and a pair of side plate through holes, each of said plurality of tubes extending through a respective one of said plurality of tube holes, each of said pair of side plates extending through a respective one of said pair of side plate through holes; and a pair of tanks, each of said tanks engaging a respective core plate to define a sealed space, each of said longitudinal ends of said tubes being disposed within a respective sealed space, each of said longitudinal ends of said side plates being disposed outside of said sealed spaces, wherein each of said longitudinal ends of said side plates also protrude into a respective separate cavity defined by an outer portion of each of said tanks, said longitudinal ends of said side plates positioned through said through holes and free from contact with any wall of said respective separate cavity.

2. The heat exchanger according to claim 1 further comprising a non-brazed connection between each of said core plates and each of said side plates.

3. The heat exchanger according to claim 1 wherein each of said core plates defines a plurality of claw portions, each of said claw portions engaging a respective tank.

4. The heat exchanger according to claim 3 wherein said tanks are rectangular in shape, at least one of said claw portions engaging each side of said rectangular tank.

5. The heat exchanger according to claim 4 wherein each of said core plates defines a tank insertion portion, each of said tanks being disposed within a respective tank insertion portion.

6. The heat exchanger according to claim 5 further comprising a seal, wherein the seal is a separate physical part and is disposed between each of said tanks and each of said respective tank insertion portions.

7. The heat exchanger according to claim 6 wherein each of said tanks defines a plurality of reinforcement ribs.

8. The heat exchanger according to claim 4 wherein each of said core plates defines a sealing surface, each of said tanks engaging a respective sealing surface.

9. The heat exchanger according to claim 8 further comprising a seal, wherein the seal is a separate physical part and is disposed between each of said tanks and each of said sealing surfaces.

10. The heat exchanger according to claim 9 wherein each of said tanks defines a plurality of reinforcement ribs.

11. The heat exchanger according to claim 4 wherein each of said tanks defines a plurality of reinforcement ribs.

12. The heat exchanger according to claim 4 further comprising a non-brazed connection between each of said core plates and each of said side plates.

13. The heat exchanger according to claim 3 further comprising a seal, wherein the seal is a separate physical part; and a tank insertion portion defined by each of said core plates, wherein said seal and said tanks are disposed within said tank insertion portion, said seal located between each of said tanks and each of said core plates.

14. The heat exchanger according to claim 13 wherein each of said tanks defines a plurality of reinforcement ribs.

15. The heat exchanger according to claim 3 wherein each of said core plates defines a sealing surface with a physical seal as a separate part, said physical seal disposed between each of said tanks and each of said sealing surfaces with each of said tanks engaging a respective physical seal.

16. The heat exchanger according to claim 14 wherein each of said tanks defines a plurality of reinforcement ribs.

17. The heat exchanger according to claim 3 further comprising a non-brazed connection between each of said core plates and each of said side plates.

18. The heat exchanger according to claim 3 wherein each of said tanks defines a plurality of reinforcement ribs.

19. A heat exchanger comprising:

a plurality of tubes;

a plurality of fins, each of said fins being disposed adjacent at least one of said plurality of tubes;

a pair of side plates, each of said side plates being disposed adjacent an outermost fin;

a pair of core plates, each of said core plates being disposed at a longitudinal end of said tubes and said side plates, each of said core plates defining a plurality of tube holes and a pair of side plate holes, each of said plurality of tubes extending through a respective one of said plurality of tube holes, each of said pair of side plates extending through a respective one of said pair of side plate holes; and a pair of rectangular-shaped tanks, each of said tanks engaging a respective core plate to define a sealed space, each of said longitudinal ends of said tubes being disposed within a respective sealed space, each of said longitudinal ends of said side plates being disposed outside of said sealed spaces, wherein each of said core plates defines a plurality of claw portions, each of said claw portions engaging a side of said tanks;

a plurality of seals, wherein each of said seals is a separate physical part and disposed between an outer peripheral portion of each of said tanks and each of said respective tank insertion portions; and a plurality of cavities defined in said outer peripheral portions of said tanks, wherein each of said longitudinal ends of said side plates protrude into one of said cavities, said cavities located between said sealed space and said claw portions of said core plates, said longitudinal ends not in contact with walls of said cavities.

20. A heat exchanger comprising:

a plurality of tubes;

a plurality of fins, each of said fins being disposed adjacent at least one of said plurality of tubes;

a pair of side plates, each of said side plates being disposed adjacent an outermost fin;

a pair of core plates, each of said core plates being disposed at a longitudinal end of said tubes and said side plates, each of said core plates defining a plurality of tube holes and a pair of side plate holes, each of said plurality of tubes extending through a respective one of said plurality of tube holes, each of said pair of side plates extending through a respective one of said pair of side plate holes; and a pair of rectangular-shaped tanks, each of said tanks engaging a respective core plate to define a sealed space, each of said longitudinal ends of said tubes being disposed within a respective sealed space, each of said longitudinal ends of said side plates being disposed outside of said sealed spaces, wherein each of said core plates defines a plurality of claw portions, each of said claw portions engaging a side of said tanks;

a plurality of seals, wherein each of said seals is a separate physical part and disposed between an outer peripheral portion of each of said tanks and each of said respective tank insertion portions; and a plurality of cavities defined in said outer peripheral portions of said tanks, wherein each of said longitudinal ends of said side plates protrude into one of said cavities, said cavities located between said sealed space and said claw portions of said core plates, said longitudinal ends not in contact with walls of said cavities, said side plate holes disposed between said seals and said claw portions and located adjacent an open side of said cavities.

* * * * *